US006305123B1

(12) United States Patent
Davies et al.

(10) Patent No.: US 6,305,123 B1
(45) Date of Patent: Oct. 23, 2001

(54) OBSTRUCTION SENSING A SIGNAL TRANSMITTED ACROSS WINDOW

(75) Inventors: Timothy Davies, Hermitage; Charles Hopson, Lebanon, both of TN (US); Pascal Bonduel, Bouzy la Foret; Francios Breynaert, Caen, both of (FR); Christos Kyrtsos, Southfield; Joseph Tyckowski, Clawson, both of MI (US)

(73) Assignee: Meritor Light Vehicle Systems, LLC, Troy, MI (US)

( * ) Notice: Subject to any disclaimer, the term of this patent is extended or adjusted under 35 U.S.C. 154(b) by 0 days.

(21) Appl. No.: 09/398,734

(22) Filed: Sep. 17, 1999

(Under 37 CFR 1.47)

(51) Int. Cl.[7] ..... E05F 15/02
(52) U.S. Cl. ..... 49/26; 318/280
(58) Field of Search ..... 49/26, 27, 28; 318/280, 281, 282, 289, 293, 467

(56) References Cited

U.S. PATENT DOCUMENTS

| | | | | |
|---|---|---|---|---|
| 4,453,112 | | 6/1984 | Sauer et al. . | |
| 4,786,783 | * | 11/1988 | Woodard | 219/547 |
| 5,196,826 | * | 3/1993 | Whiting | 49/26 |
| 5,543,601 | * | 7/1996 | Bartrug et al. | 218/203 |
| 5,774,046 | * | 6/1998 | Ishihara et al. | 49/26 |
| 5,796,389 | * | 8/1998 | Bertram et al. | 345/173 |
| 5,955,854 | * | 9/1999 | Zhang et al. | 49/26 |
| 5,966,071 | * | 10/1999 | Tsuge et al. | 49/26 |
| 5,974,262 | * | 8/1998 | Fuller et al. | 395/838 |
| 5,983,567 | * | 11/1999 | Mitsuda | 49/26 |
| 6,039,390 | * | 11/1988 | Argrawal et al. | 296/211 |

FOREIGN PATENT DOCUMENTS

| | | | | |
|---|---|---|---|---|
| 2453439 | | 5/1975 | (DE) . | |
| 3137351 | * | 4/1983 | (DE) | 49/26 |
| 4201019 | * | 4/1983 | (DE) | 49/28 |
| 3513051 | | 10/1986 | (DE) . | |
| 405071269 | * | 3/1993 | (JP) | 49/28 |
| 8908952 | * | 9/1989 | (WO) | 49/26 |

* cited by examiner

*Primary Examiner*—Daniel P. Stodola
*Assistant Examiner*—Curtis A. Cohen
(74) *Attorney, Agent, or Firm*—Carlson, Gaskey & Olds, P.C.

(57) ABSTRACT

In a first embodiment, a vehicle window obstruction system incorporates a conductive coating placed on the window. Such coatings are known for use in defrost systems. A voltage source is connected to the conductive coating, such that an electrical charge is placed across the window. Electrical characteristics of the charge are monitored, and compared to expected values. In the event that an obstruction is encountered, the monitored values will differ from expected values, and a control can indicate the presence of an obstruction. Alternatively, the signal could be a high frequency signal such as a sound signal which would be varied when the window contacts a human obstruction.

7 Claims, 2 Drawing Sheets

OBSTRUCTION SENSING A SIGNAL TRANSMITTED ACROSS WINDOW

BACKGROUND OF THE INVENTION

This invention relates to monitoring a signal passed across a window. When the window encounters an obstruction, the signal will change and an indication then be made that an obstruction is in the window path.

Modern vehicles typically have several windows which are movable automatically. In this application, the term "window" should be understood to include not only side windows in the vehicle, but also other moveable closures such as rear windows, sunroofs, etc.

Typically, in the prior art, a switch may be actuated, and the window will then close automatically. There are sometimes obstructions in the way of the window. As an example, a passenger's arm may extend outwardly of the window opening when the window is being closed.

The prior art has attempted to identify such obstructions by monitoring the current or torque load on the motor. When a particular characteristic of the load on the motor is seen, an indication is made that an obstruction has been encountered.

It would be desirable to provide an indicator of an obstruction which is more directly related to the window and its contact with an obstruction.

SUMMARY OF THE INVENTION

In one disclosed embodiment of this invention, an electrical charge is placed across a coating on a vehicle window. The electrical characteristics of the charge are monitored. If an obstruction is encountered, then some change in the electrical characteristic will occur. The change can be associated with an indication that an obstruction has been encountered.

In one example, a conductive coating such as provided on vehicle windshields for defrosting may be utilized. A low voltage is applied across this conductive coating. A monitor monitors the current, resistance, or other electrical characteristic of the charge placed across the coating. When an obstruction is encountered by the window, the charge will change. The monitored characteristic is compared to expected values. If the monitored value differs from the expected value, then an indication can be made that an obstruction has been encountered.

In another embodiment, a high frequency signal is passed through the glass. This signal, which may be a sound wave, or some electromagnetic signal, would have a predictable amplitude and other characteristics if measured at a remote location associated with the glass. However, if the window bearing that signal contacts an object such as a human body, the human body would effectively become an antenna changing the characteristic. A sensor placed near the window, such as in the car seat, would be able to detect this variation. The signal magnitude would obviously be provided low enough such that it would have no detrimental effect on the human which contacts the window. Further, the frequency could be fine tuned to distinguish between a human obstruction and some other obstruction.

In the event an obstruction is identified, the window movement may be stopped or reversed.

These and other features of the present invention can be best understood from the following specification and drawings, the following of which is a brief description.

DETAILED DESCRIPTION OF THE PREFERRED EMBODIMENT

Figure 1:
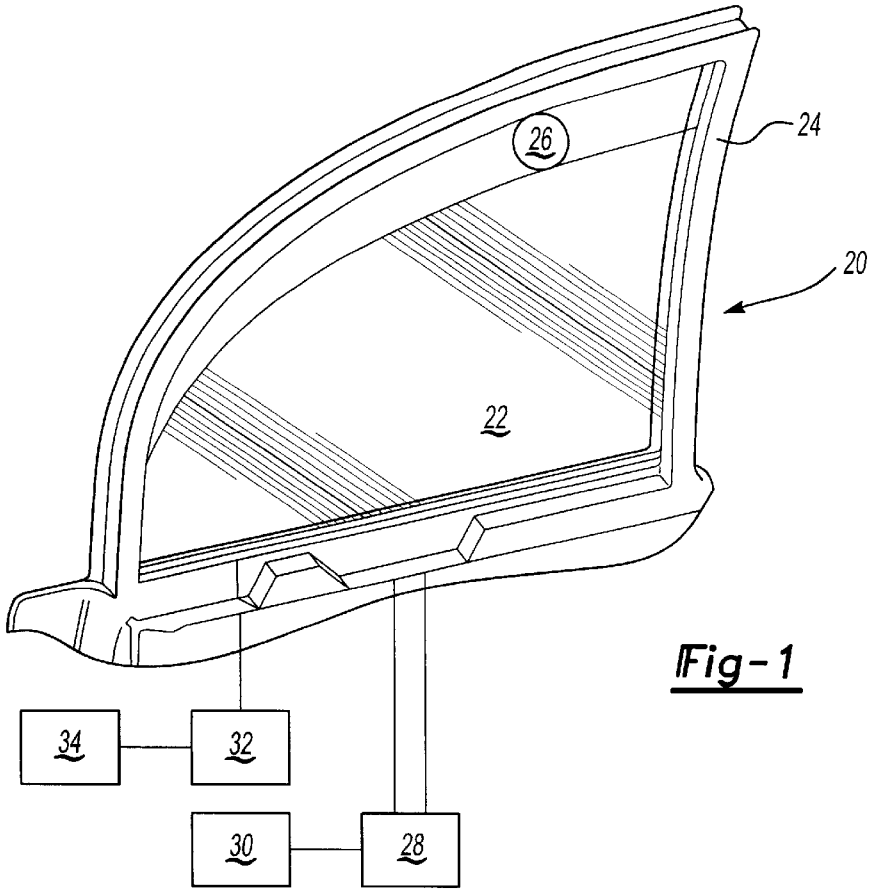
FIG. 1 is a schematic view of a window incorporating a first embodiment of the present invention.

FIG. 1 shows a window drive system 20 incorporating a movable window 22. A frame 24 surrounds the window 22. An obstruction 26 is shown in the path of the window 22. A linkage 28 is driven by a motor 30 to drive the window 22 upwardly to a fully closed position.

A voltage source 32 provides a voltage to the window 22. A monitor 34 monitors an electrical characteristic of the electrical charge placed on the window 22.

Figure 2:
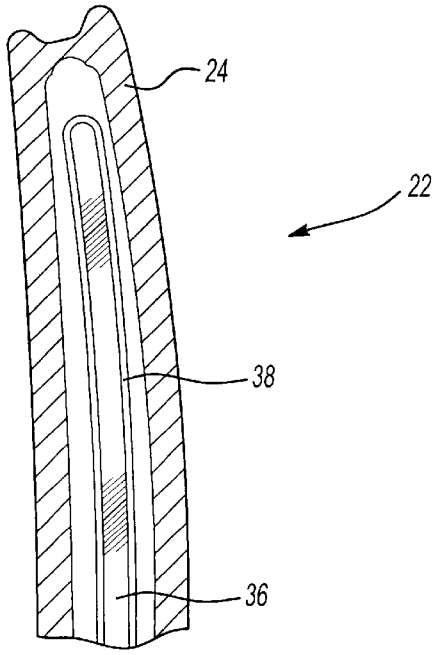
FIG. 2 is a cross-sectional view through an upper portion of the FIG. 1 window.

As can be seen in FIG. 2, the window includes an underlying glass 36 and an outward conductive coating 38. Coating 38 may be similar to the coating type utilized for defrosting vehicle windshields.

Now, when the window is being driven upwardly by the motor 30, a charge is placed on coating 38 by the voltage source 32. An appropriate control is provided, and need only apply the voltage when the window is being moved upwardly. The sensor 34 senses an electrical characteristic such as current, resistance, etc., and compares that sensed characteristic to respective characteristics.

In the event an obstruction, such as 26, is encountered, then there will be a localized force on the window at the location of the obstruction 26. This would change the electrical characteristic. When a changed electrical characteristic is sensed, the control provides an instruction to the motor 30 to either stop or reverse further movement of the window 22.

Figure 3:
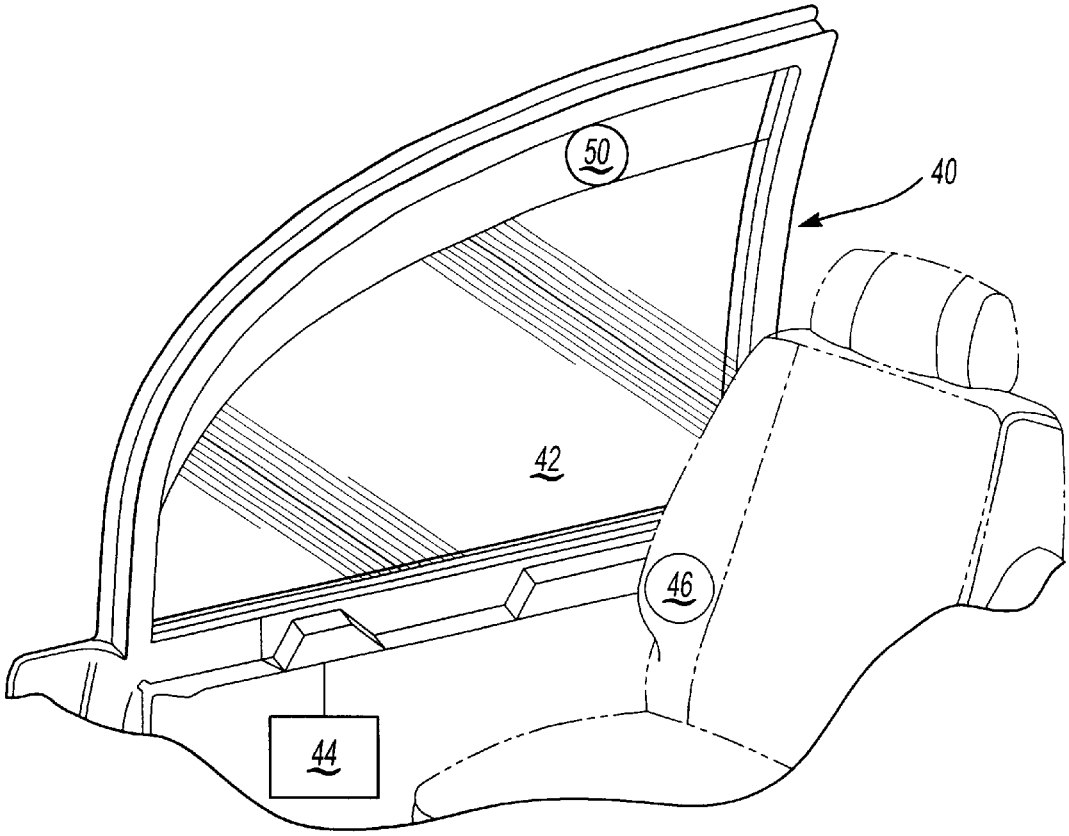
FIG. 3 shows an alternative embodiment.

As shown in FIG. 3, a second embodiment 40 incorporates a window 42, driven by a linkage, not shown, and having a source of a signal, such as a high frequency sound wave 44 putting a signal across the glass. A sensor 46 is positioned near the window, such as in the car seat adjacent to the window. When an object, such as arm 50 is contacted by the window, the human in contact with the window effectively would become an antenna changing the characteristics of the signal. The sensor would be able to detect this change. The sensor would be expecting a predicted characteristic, and would be able to sense the changed characteristic much like the earlier embodiments. This invention could also be fine tuned such that it would be sophisticated enough to distinguish between a human "obstruction" and a non-human object in the way of the window.

Further, the control is preferably sophisticated enough to recognize the fully up position of the window 22, and not identify an obstruction when the window is fully closed.

A preferred embodiment of this invention has been disclosed. However, a worker of ordinary skill in this art would recognize that certain modifications would come within the scope of this invention. For that reason, the following claims should be studied to determine the true scope and content of this invention.

What is claimed is:

1. A vehicle window assembly comprising:

a window pane moveable within a window frame;

a linkage for driving said window pane to a closed position;

a motor, and a switch for requesting closure of said window pane by said motor; and said window pane attached to a signal source, a frequency signal being applied to said window pane by said source, and a sensor for monitoring a characteristic of said frequency signal applied to said window, and a control for determining whether an obstruction is in contact with said window pane based upon a change in said monitored characteristic received from said sensor.

2. A vehicle window assembly as recited in claim 1, wherein said signal varies when an object contacts said window.

3. A vehicle window assembly as recited in claim 2, wherein said sensor is placed adjacent to said window.

4. A vehicle window assembly comprising:

a window pane movable within a window frame;

a linkage for driving said window pane to a closed position;

a motor, and a switch for requesting closure of said window pane by said motor; and said window pane having a conductive coating, and a voltage source applying a voltage to said conductive coating, a monitor connected to the voltage source for monitoring an electrical characteristic of the voltage on the window pane, said monitor comparing the monitored characteristic to expected characteristics and identifying an obstruction should the monitored characteristic differ from expected characteristics.

5. A vehicle window assembly comprising:

a window pane moveable within a window frame;

a linkage for driving said window pane to a closed position;

a motor, and a switch for requesting closure of said window pane by said motor; and said window pane attached to a signal source, a signal being applied to said window pane by said source, and a sensor attached to said source for monitoring a characteristic of said signal applied to said window pane, and a control for determining whether an obstruction is in contact with said window pane based upon a change in said monitored characteristic, said signal being a high frequency signal passed across said window.

6. A vehicle window assembly as recited in claim 5, wherein said high frequency signal is a sound wave.

7. A method of identifying an obstruction in a movable window comprising the steps of:

(1) providing a conductive window coating on said window;

(2) providing a signal to said conductive coating;

(3) moving said window to a closed position; and (4) monitoring a characteristic of said signal during said moving of said window, and identifying an obstruction and reversing said window movement should said monitored characteristic differ from an expected characteristic.

* * * * *